US006631751B2

(12) United States Patent
Coles et al.

(10) Patent No.: US 6,631,751 B2
(45) Date of Patent: Oct. 14, 2003

(54) VERTICAL FRAME STRUCTURES

(76) Inventors: Harold G. Coles, 32870 - 2nd Avenue, Mission, British Columbia (CA), V2V 1J2; Lynn A. Pedersen, 15831 - 102A Avenue, Surrey, British Columbia (CA), V4N 2M8

( * ) Notice: Subject to any disclaimer, the term of this patent is extended or adjusted under 35 U.S.C. 154(b) by 0 days.

(21) Appl. No.: 10/043,341

(22) Filed: Jan. 14, 2002

(65) Prior Publication Data

US 2003/0131952 A1 Jul. 17, 2003

(51) Int. Cl.[7] ..... A47G 5/00
(52) U.S. Cl. ..... 160/351; 248/188.8; 108/157.1
(58) Field of Search ..... 160/135, 351; 52/239; 248/188.7, 188.8; 108/157.1

(56) References Cited

U.S. PATENT DOCUMENTS 2,919,878 A * 1/1960 Nathan
3,213,580 A * 10/1965 Mark
3,232,370 A * 2/1966 Jaffe
3,325,017 A * 6/1967 Tucker ..... 211/193
3,844,079 A * 10/1974 Karrip
3,889,315 A * 6/1975 Stouffer
3,955,298 A * 5/1976 Kapstad
4,197,685 A * 4/1980 Goulish et al.
4,344,475 A * 8/1982 Frey
4,984,761 A * 1/1991 Chen

FOREIGN PATENT DOCUMENTS

DE 1812442 * 6/1970
FR 598636 * 10/1925

* cited by examiner

*Primary Examiner*—Blair M. Johnson

(57) ABSTRACT

A garden, patio or other screen or other vertical frame structure has a frame formed of elongate extruded plastic members, which include vertical frame elements, and a panel in the frame. The vertical frame elements have hollow interiors and downwardly open bottom openings. Metal L-shaped support members have vertical portions extending upwardly through the bottom openings into frictional engagement in the hollow interiors of the vertical frame elements, and horizontal portions extending forwardly and rearwardly of the screen from the vertical portions.

10 Claims, 3 Drawing Sheets

VERTICAL FRAME STRUCTURES

BACKGROUND OF THE INVENTION

1. Field of the Invention

The present invention relates to vertical frame structures, for example screens, and is useful in particular, but not exclusively, for garden and patio screens.

2. Description of the Related Art

A conventional garden screen is formed by a panel, for example a lattice panel, installed between a pair of posts which are embedded, at their lower ends, in the ground or in concrete. However, this type of screen is difficult and expensive to install and cannot be easily removed for reinstallation in a different location.

BRIEF SUMMARY OF THE INVENTION

It is accordingly an object of the present invention to provide a novel and improved screen which can be easily installed in almost any convenient location and which can be easily removed from that location to another location when desired.

According to the present invention, a screen is provided which comprises a frame formed of elongate extruded plastic members, which include vertical frame elements, and a panel in the frame. The vertical frame elements have hollow interiors and downwardly open bottom openings. Support members have vertical portions extending upwardly through the bottom openings into snug engagement in the hollow interiors of the vertical frame elements, and horizontal portions extending beneath the vertical portions.

To install a screen according to the present invention, it is merely necessary to insert the vertical portions of the support members through the bottom openings and into the hollow interiors of the vertical frame elements. The horizontal portions of the support members can then be placed on the ground or on any other suitable support, to which, if necessary, they can be secured by screws or bolts.

When it is desired to relocate to the present screen, any screws or bolts securing the horizontal portions of the support members can be removed and the support members can easily be withdrawn from the interiors of the extruded plastic members. The screen can then be conveniently stored and transported, as required, and can easily be reinstalled in a different location.

BRIEF DESCRIPTION OF THE DRAWINGS

The invention will be more readily understood from the following description of a preferred embodiment thereof given, by way of example, with reference to the accompanying drawings, in which.

DESCRIPTION OF THE PREFERRED EMBODIMENT

Figure 1:
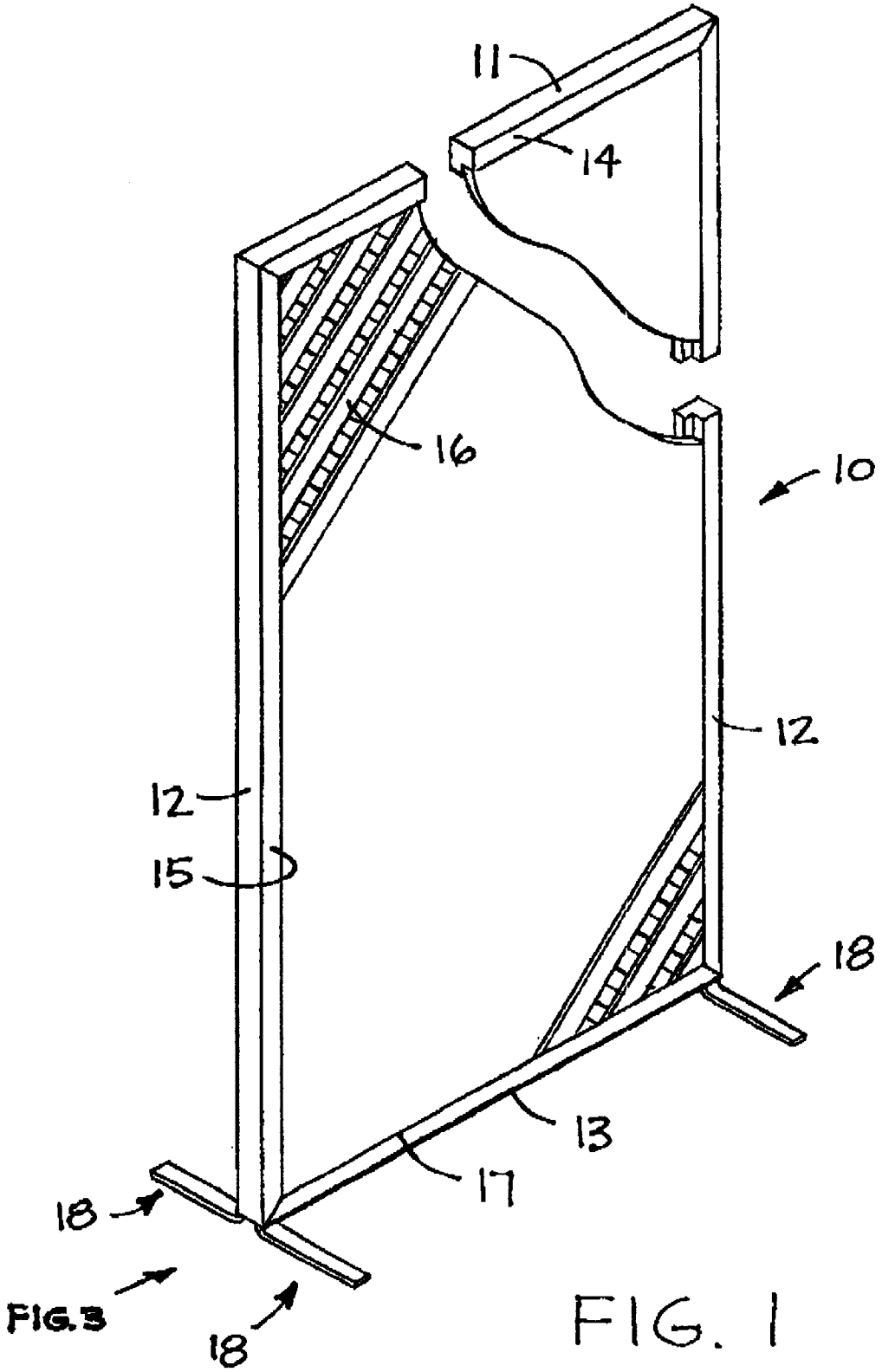
FIG. 1 shows a view in perspective of a screen embodying in the present invention.

In FIG. 1 of the accompanying drawings, reference numeral 10 indicates generally a screen which comprises a frame, and more particularly a rectangular frame formed by a pair of vertical side frame elements 12, a horizontal top frame element 14 and a horizontal bottom frame element 17, with a panel 16 installed in the frame 10 and with L-support members indicated generally by reference numerals 18 supporting the frame 10 in a vertical position. The frame 10 has a top 11, a bottom 13, a front 15 and a rear 9. The frame elements 12, 14 and 15 are plastic extrusions with mitred ends welded to one another to form the frame 10.

Figure 2:
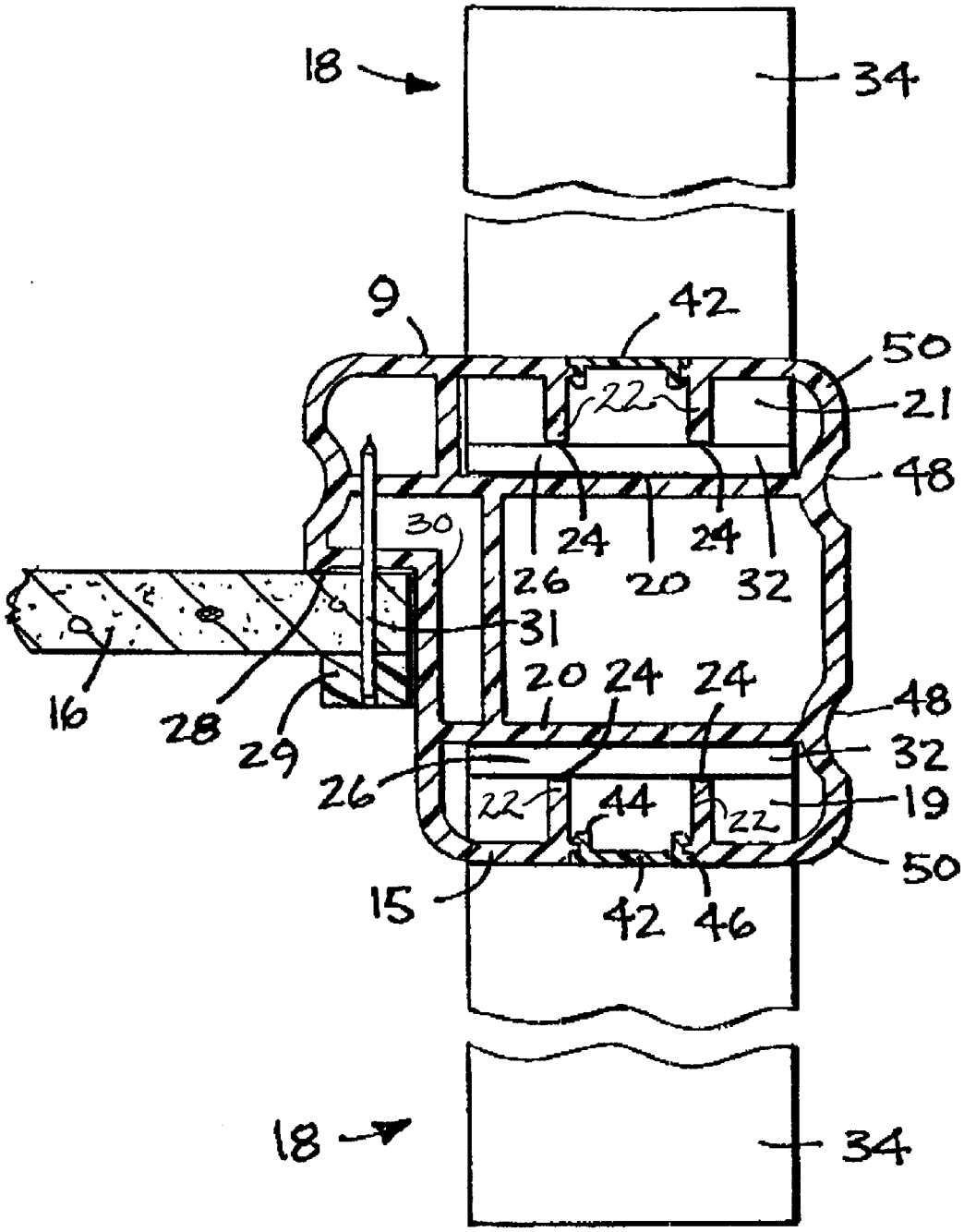
FIG. 2 shows a view taken in horizontal cross-section through a frame forming part of the screen of FIG. 1.

FIG. 2 shows a view taken in horizontal cross-section through one of the vertical side frame elements 12.

The frame element 12 shown in FIG. 2 has a hollow interior including a front hollow recess 19 and a rear hollow recess 21 between which a pair of interior partition walls 20 extend longitudinally and transversely of the frame element 12. Also, pairs of parallel flanges 22 are spaced from one another at the front and the rear sides of the frame element 12. The flanges 22 extend longitudinally of the hollow interior of the frame element 12 at right angles to the walls 20 and have edges 24 which are spaced from the walls 20 by gaps 26.

The frame element 12 is also formed with a vertically and longitudinally extending shoulder 28 adjacent a flat side wall 30, which abuts an edge of the panel 16, and the panel 16 is tacked to the frame 10 by nails, one of which is shown and is indicated by reference numeral 3 1, extending through an insert strip 20 of plastic material extending around the margin of the panel 16 and through the panel 16 into the shoulder 28.

Figure 3:
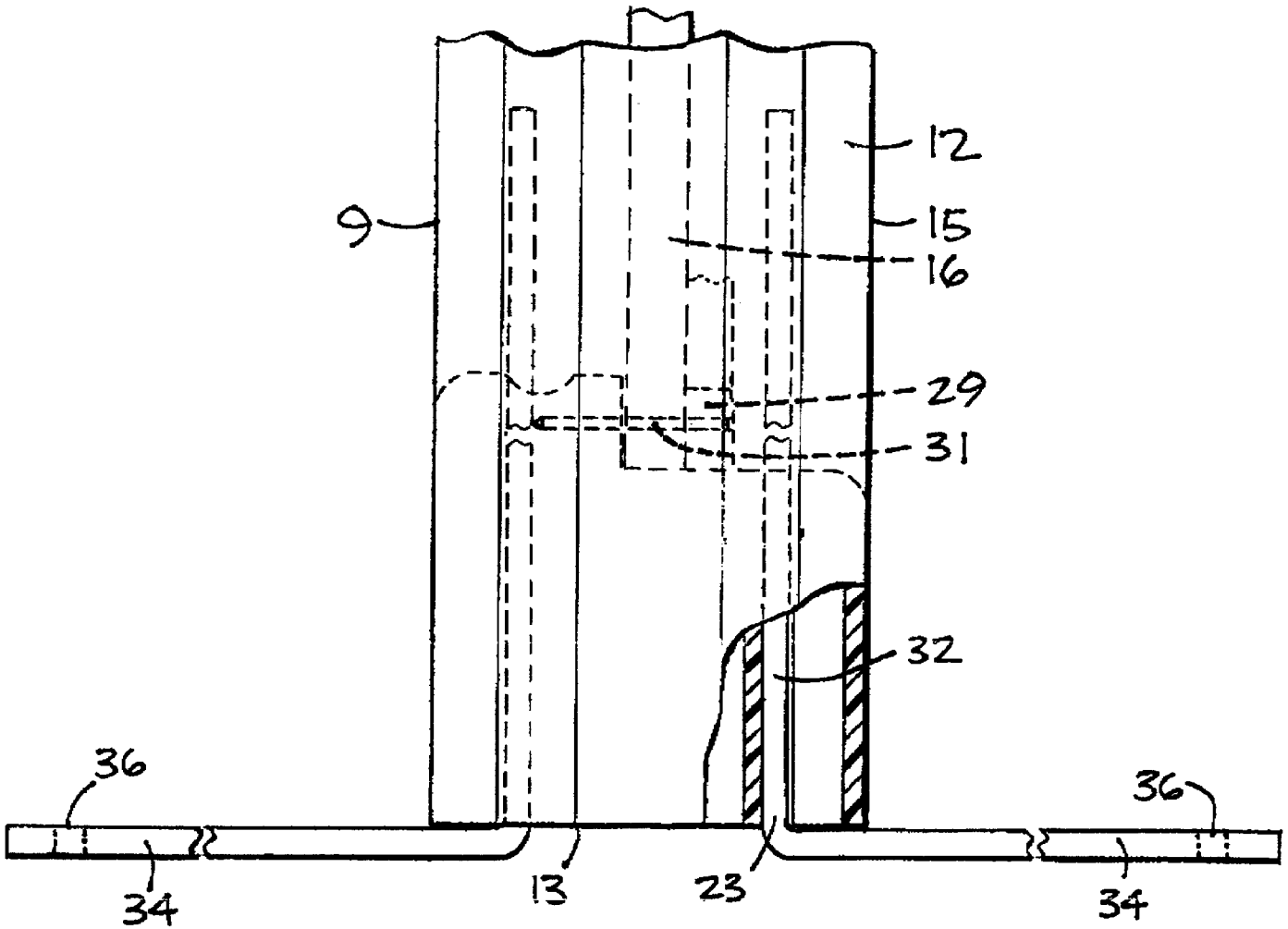
FIG. 3 shows a broken-away view in side elevation of a pair of support members inserted into a part of the frame of the screen of FIGS. 1 and 2.

Downwardly facing openings, one of which is indicated by reference numeral 23 in FIG. 3, are cut in the bottom 13 of the frame beneath the hollow spaces 19 and 21.

The support members 18 are L-shaped and, in the present embodiment of the invention, are each formed from a bent length of aluminum strip material. As can be seen from FIG. 3, each support member 18 has a vertical portion 32 and a horizontal portion 34 extending from the lower end of the vertical portion 32 at right angles to the vertical portion 32. The vertical portions 32 are inserted upwardly through the openings 23 in the bottom 13 of the frame into the gaps 26 and thus into engagement with the frame elements 12 in the recesses 19 and 21 in tight frictional engagement between the walls 20 and the edges 24 of the flanges 24.

As can also be seen from FIG. 3, the horizontal portions 34 of the support members 18 project forwardly and rearwardly, respectively, of the screen 10. The horizontal portions 34 may be formed with through openings 36 for receiving screws or bolts (not shown), by means of which the horizontal portions 34 can be securely fixed in position on a suitable support (not shown), for example a horizontal beam or a concrete block. Alternatively, pots or other weights may be placed on the horizontal portions 34 to retain them in position.

As will be readily apparent, the assembly and installation of the screen 10 are extremely simple. For that purpose, it is merely necessary to insert the vertical portions 32 of two of the supports 18 upwardly into each frame element 12 at the front and rear, respectively, of the screen 10. The screen 10 is then self-supporting and may be used, for example, as a privacy screen in a garden or patio, or on a balcony or a deck or other outdoor living space, and is also suitable for use around a hot tub. If required, the screen 10 can be installed adjacent and in abutment with a similar screen (not shown), with the screens aligned with one another or angled relative to one another.

If necessary, the vertical portions 32 of the support members 18, which are in frictional engagement with the frame elements 12, can be slid partly outwardly from the frame elements 12 in order to adapt the screen 10 to uneven ground. In this way, the screen 10 can be installed in a vertical position on sloping ground.

Each pair of flanges 24 is spaced apart by a gap 40 which extends longitudinally of the respective frame element 12 from the interior to the exterior of the frame element 12. This gap 40 is closed, at the outer surface of the frame element 12, by an inset strip 42, which is secured in position by a snap-action into interengagement of projecting ribs 44 on the frame element 12 in corresponding recesses 46 in the strips 42.

The frame elements 12 are extruded from polyvinyl chloride and are suitable for use in all weather conditions and all climates, and are formed with rounded concave recesses 48 and convexly rounded corners 50 which enable a pair of the frame elements 12, forming parts of a pair of similar adjacent frames 10, to abut one another with one of the corners 50 of one of the frame members engaged in one of the recesses 48 of the adjacent frame element 12 of the other frame 10. The two frames 10 can thus be arranged at an angle to one another, with one of their support members 18 omitted.

As will be apparent to those skilled in the art, various modifications of the above-described screen may be made within the scope of the present invention.

For example, the panel 16 is shown as a lattice in FIG. 1 but may alternatively be in the form of a solid panel, for example a concrete fibreboard panel. The invention may be embodied as a barrier, e.g. a crowd control barrier, or as an advertising sign, instead of as the above-described screen.

I claim:

1. A vertical frame structure, comprising:

a frame;

a panel in said frame;

said frame having a front, a rear, a top, a bottom and a pair of opposite vertical side elements;

said vertical side elements each having a pair of elongate, vertical recesses, and bottom openings in said bottom of said frame; and a pair of L-shaped support members associated with each of said vertical side elements;

said L-shaped support members each having a horizontal portion and a vertical portion and said vertical portions extending upwardly from said horizontal portions through said bottom openings into frictional engagement with said vertical side members within respective ones of said vertical recesses; and said horizontal portions of each of said pairs of L-shaped support members projecting from said front and said rear, respectively, of said frame.

2. A vertical frame structure has claimed in claim 1, wherein said vertical side elements each comprise a plastic extrusion having a hollow interior, and said recesses extend longitudinally of said vertical side elements along said hollow interiors.

3. A panel assembly as claimed in claim 1, wherein said vertical side elements each include a pair of parallel internal partition walls between said vertical recesses, and pairs of flanges extending at right angles to respective ones of said partition walls, said flanges having edges spaced from said walls by gaps which are equal and which accommodate said vertical portions of said L-shaped member in snug engagement between said flange edges and said partition walls.

4. A screen, comprising:

a frame formed of elongate extruded plastic members;

said members including vertical frame elements located at a bottom region of said frame at opposite sides of said frame;

said vertical frame elements having hollow interiors and downwardly open bottom openings; and support members having vertical portions extending upwardly through said bottom openings into said vertical frame elements and horizontal portions extending from lower ends of the vertical portions; and said vertical frame elements each defining separate gaps within its hollow interior; and said vertical portions being received in said gaps in frictional engagement with said vertical frame elements.

5. A screen as claimed in claim 4, including a panel in said frame, said panel having vertical edge portions and said vertical frame elements are formed with longitudinal shoulders abutting said vertical edge portions of said panel.

6. A screen as claimed in claim 4, wherein said support members are L-shaped.

7. A screen as claimed in claim 4, wherein a pair of said support members are inserted into each of said vertical frame elements and the horizontal portions of said pair project forwardly and rearwardly, respectively, of said panel.

8. A screen as claimed in claim 4, wherein said vertical frame elements each have interior gaps for receiving said vertical portions of said support members in frictional engagement with said vertical frame element, said interior gaps each being defined by a wall extending longitudinally and transversely of the interior of said vertical frame element and a pair of flanges which are spaced from one another and which extend at right angles to said a wall, said flanges having edges spaced from said walls to define said gaps.

9. A screen as claimed in claim 4, wherein said vertical frame elements have longitudinal gaps each defined by a pair of flanges and open outwardly of said extruded plastic members and plastic strips inserted into and closing said gaps.

10. A screen, comprising:

a panel;

a rectangular frame extending around said panel and having a front, a rear, a top and a bottom;

said frame having downwardly open openings in said bottom of said frame and hollow spaces extending upwardly within said frame from said openings;

L-shaped support members at said bottom of said frame;

said support members having vertical portions extending upwardly through said openings in frictional engagement with said frame within said hollow spaces and horizontal portions projecting forwardly and rearwardly of said screen;

wherein said hollow spaces comprise adjacent pairs of hollow spaces and each of said pairs comprises a front hollow space adjacent said front of said frame and a rear hollow space adjacent said rear of said frame;

said support members are L-shaped and a pair of said support members have said vertical portions thereof inserted into respective ones of said front and rear hollow spaces from said bottom of said screen.

* * * * *